United States Patent [19]

Douglas

[11] Patent Number: 4,673,114

[45] Date of Patent: Jun. 16, 1987

[54] GARMENT DRYING HANGER

[76] Inventor: Helen E. Douglas, 18536 Centennial, Hesperia, Calif. 92345

[21] Appl. No.: 896,831

[22] Filed: Aug. 15, 1986

[51] Int. Cl.[4] ..... A47G 25/44

[52] U.S. Cl. ..... 223/89; 223/94; D6/318; D6/319

[58] Field of Search ..... 223/89, 90, 94; 211/118; D6/318, 319

[56] References Cited

U.S. PATENT DOCUMENTS 2,722,351 11/1955 Dyer ..... 223/89
2,883,095 4/1959 Greenbaum ..... 223/90

FOREIGN PATENT DOCUMENTS 1074554 4/1954 France ..... 223/90
1204121 8/1959 France ..... 223/89
490912 10/1951 Italy ..... 223/89
760301 10/1956 United Kingdom ..... 223/94

*Primary Examiner*—Robert R. Mackey
*Attorney, Agent, or Firm*—George J. Netter

[57] ABSTRACT

Each hanger arm includes a stub shaft with a locking notch immediately adjacent. Elongated extender arms, one for each hanger arm, each include a hollow end which can be received onto a locking stub shaft and have detent parts to be snapped into the adjacent locking notch. To release an extender arm from the hanger body, it is swung outwardly and upwardly a slight amount, which removes the detent from the notch allowing the extender arm to be pulled off the hanger body stub shaft. The outer end of an extender arm may be provided with a similar stub shaft enabling a second extender arm to be releasably locked to a first extender arm providing further total arm length.

1 Claim, 5 Drawing Figures

GARMENT DRYING HANGER

The present invention pertains to an improved garment hanger, and more particularly to a hanger for use during drying of a sweater or the like, for maintaining the general form of the garment and reducing unusual stretching or wrinkling.

OBJECT AND SUMMARY OF THE PRESENT INVENTION

It is, therefore, a primary aim and object of this invention to provide an improved drying hanger for a sweater or like garment having selectively connectable arms enabling use for long-sleeved garments, which arms can be removed, providing use of the basic hanger in conventional manner.

In the practice of the present invention, there is provided a garment hanger having a central body portion from which a hook extends for use in hanging. Two arms slope downwardly from each side of the central portion with a cross bar for reinforcement.

Each of the hanger arms includes a stub shaft immediately adjacent which a locking notch is provided. Elongated extender arms, one for each hanger arm, each include a hollow end which can be received onto a locking stub shaft and have detent parts to be snapped into the locking notch, thereby providing extender arms on both sides of the hanger releasably locked into place during use. To release the extender arms from the hanger body, they are swung outwardly and upwardly a slight amount, which releases the respective notches allowing the extender arms to be pulled off the hanger body stub shafts.

The outer end of an extender arm may be provided with a similar stub shaft to that on the hanger enabling a second extender arm to be releasably locked to the first extender arm providing further arm length to the drying garment hanger.

DESCRIPTION OF A PREFERRED EMBODIMENT

Figures 1, 2, 3, 4, 5:
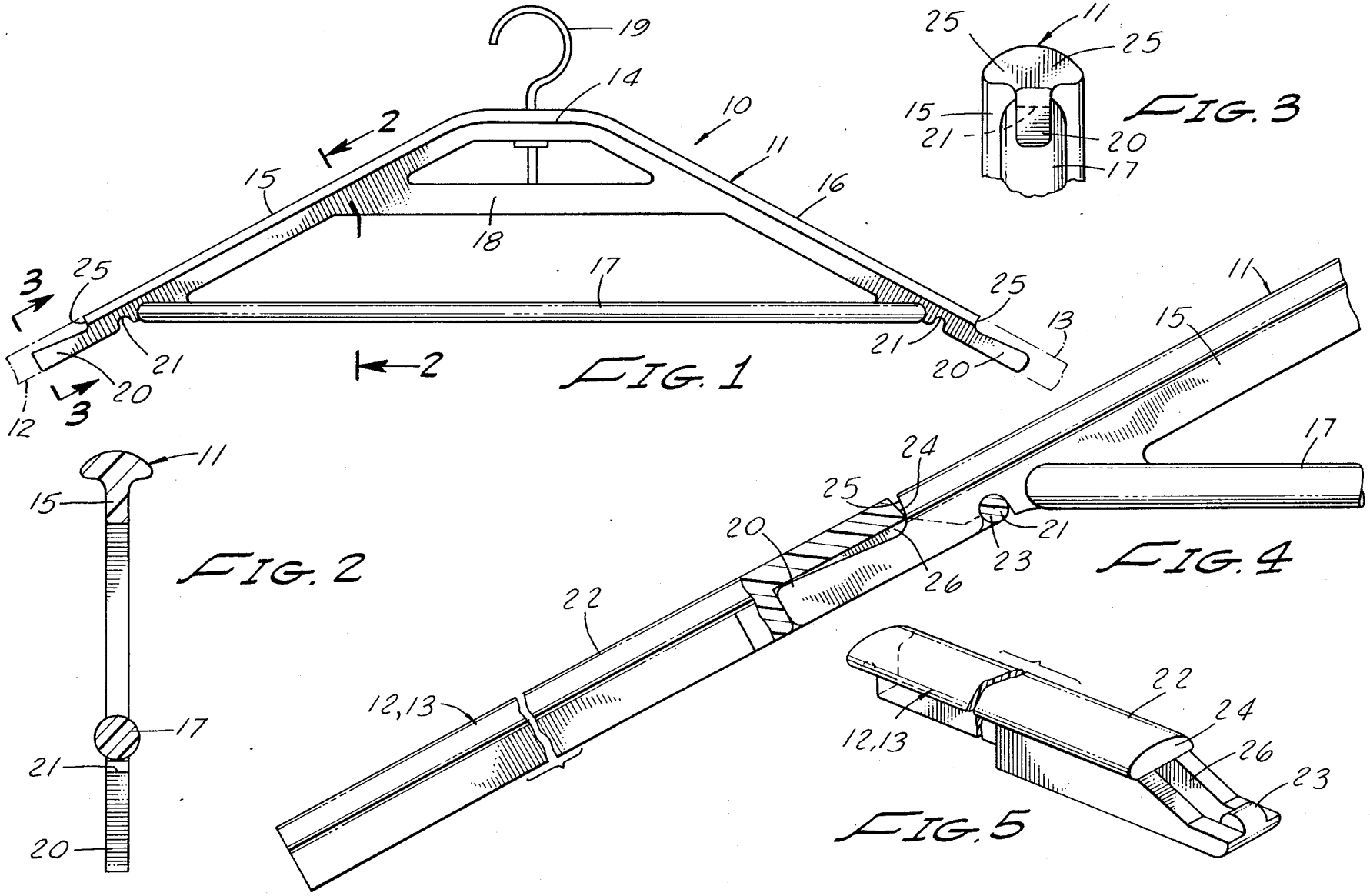
FIG. 1 is a front elevational view of the garment drying hanger of this invention.
FIG. 2 is a sectional view taken along line 2—2 of FIG. 1.
FIG. 3 is an end view of the hanger of FIG. 1.
FIG. 4 is an elevational, partially sectional view of an extender arm.
FIG. 5 is a perspective view of the extender arm interconnection means.

With reference now to the drawings, the improved garment drying hanger of the present invention is identified generally as 10 and is seen to include a hanger body 11 of generally conventional construction and including extender arms 12 and 13 which are releasably interconnected with the hanger body 11 in a way that will be described.

The hanger body 11 has a central member 14 with downwardly sloping arms 15 and 16, one at each side, with a crossbar 17 at substantially the lower edge thereof serving both to reinforce the construction as well as to provide a means for hanging such things as pants or the like thereon. A second crossbar 18 parallel to the first crossbar 17 is also provided with its ends affixed to the arms 15 and 16. A hook 19 extends upwardly from the central member and preferably is rotatably affixed thereto.

At the lower end of each arm 15 and 16, there is a stub shaft connector 20 extending in the same direction as the arms and lying in the same plane as the arms and associated crossbars. Since the stub shaft connectors are, in cross-section, rectangular shaped, and, as seen from the side, have a lower surface which is a continuation of that of its associated arm. As viewed from the side, the stub shaft connector has a maximum thickness at its end, which is less than that of the arm 15 or 16 to which it is secured, and tapers toward the arm to a minimum immediately adjacent the point at which it connects with the arm. A locking groove 21 is formed in the lower surface of the hanger arm {i.e., lower in the hanging mode} and extending transversely thereof at a point spaced inwardly of the stub shaft connectors a predetermined amount.

Although there is a stub shaft connector 20 and associated locking groove 21 at the end of each arm 15 or 16, they are identical, and, therefore, only one has been described in detail.

An extender arm 12 or 13 is an elongated member of generally one piece construction which in cross-section is seen to be generally rectangular including a rib 22 extending along the full length of one edge of the extender arm. The overall dimensions and geometry of the extender arms are identical to those of the hanger arms so that when joined together, as will be described, each appears to be a normal continuation of the other.

An end portion of the extender arm as seen from the side has curvingly sloping thickness until it terminates at a generally circular shaped detent 23 which, when viewed from in plan, is generally cylindrical. The distance from the inner edge 24 of the rib to the detent is identical to the distance between the locking groove 21 and the hanger rib edge 25.

A cavity 26 is formed within the end portion of the extender arm of such dimensions and length as to be able to accept a stub shaft connector 20 of the hanger completely therein with rib edges 24 and 25 contacting each other and the detent 23 being located within groove 21. When this occurs, it is to be noted that initially the extender and hanger arm must be arranged at a slight angle with respect to one another until the point is reached at which the detent is opposite the locking groove, at which time the extender arm is rotated a slight amount to bring the extender and hanger arm into colinear relationship. At this time the extender arm provides the additional length needed for the hanger, and is effectively locked in place and cannot be removed without reversing the steps just described, namely rotating the extender the slight amount to remove the detent from the groove and then pulling along the extender's longitudinal axis to separate the parts.

What I claim is:

1. A garment hanger, comprising:

a body portion;

first and second arms affixed to opposite sides of the body portion, lying in the same plane and sloping away from said body portion in the same general direction, each said arm including a transversely extending groove opening extending in the same general direction as the sloping of the respective arm;

first and second stub shaft means affixed respectively to the ends of the arms; and first and second extender arms each having an opening in an end portion thereof of such dimensions and geometry as to enable fitting receipt of a stub shaft therein, an end portion of the extender arm including detent means for releasable locking receipt within the arm groove when the stub shaft means is received within the extender arm opening, said extender arm end portion including the opening being curvedly tapered from a maximum thickness to a minimum thickness adjacent the detent; and said arms and extender arms each having a generally rectangular cross-section portion and a rim extending along one side thereof with flangelike portions projecting from opposite sides of the rectangular portion.

* * * * *